US007361888B1

(12) United States Patent
Boyle et al.

(10) Patent No.: US 7,361,888 B1
(45) Date of Patent: Apr. 22, 2008

(54) METHOD AND APPARATUS FOR MULTIPLEXING PLURAL ION BEAMS TO A MASS SPECTROMETER

(75) Inventors: James G. Boyle, Madison, CT (US); Robert A. Valley, Guilford, CT (US)

(73) Assignee: Analytica of Branford, Inc., Branford, CT (US)

( * ) Notice: Subject to any disclaimer, the term of this patent is extended or adjusted under 35 U.S.C. 154(b) by 0 days.

(21) Appl. No.: 11/803,581

(22) Filed: May 14, 2007

Related U.S. Application Data

(63) Continuation of application No. 10/979,623, filed on Nov. 2, 2004, now Pat. No. 7,217,919.

(60) Provisional application No. 60/516,553, filed on Oct. 31, 2003.

(51) Int. Cl.
*H01J 49/40* (2006.01)

(52) U.S. Cl. ..... 250/285; 250/287; 250/290; 250/281; 250/282

(58) Field of Classification Search ..... 250/285, 250/286, 287, 288, 292, 290, 281, 282
See application file for complete search history.

(56) References Cited

U.S. PATENT DOCUMENTS 7,019,285 B2 * 3/2006 Dresch et al. ..... 250/287
7,189,967 B1 * 3/2007 Whitehouse et al. ..... 250/292
7,217,919 B2 * 5/2007 Boyle et al. ..... 250/285

* cited by examiner

*Primary Examiner*—Kiet T. Nguyen
(74) *Attorney, Agent, or Firm*—Levisohn Berger LLP

(57) ABSTRACT

A method and apparatus for multiplexing plural ion beams to a mass spectrometer. At least two ion sources are provided with means of transporting the ions from the ion sources to separate two-dimensional ion traps. Each ion trap is used for storage and transmission of the ions and operates between the ion sources and the mass analyzer. Each ion trap has a set of equally spaced, parallel multipole rods, as well as entrance and exit sections into which and from which ions enter and exit the trap, respectively. For each ion trap, the entrance section is placed in a region where background gas pressure is at viscous flow. The pressure at the exit section drops to molecular flow pressure regimes without a break in the structure of the ion trap. Each trap alternately stores and transmits ions by way of a fast voltage switch applied to the ion trap exit lens.

34 Claims, 7 Drawing Sheets

METHOD AND APPARATUS FOR MULTIPLEXING PLURAL ION BEAMS TO A MASS SPECTROMETER

RELATED APPLICATIONS

This application is a continuation of U.S. patent application Ser. No. 10/979,623, filed Nov. 2, 2004, issuing as U.S. Pat. No. 7,217,919 on May 15, 2007—the contents of which is incorporated by reference herein—which patent and patent application were based on provisional patent application Ser. No. 60/516,553, filed Oct. 31, 2003.

References Cited

U.S. Patent Documents

| | | | |
|---|---|---|---|
| 3,740,551 | June 1973 | Green | 250/41.9ME |
| 3,831,026 | August 1974 | Powers | 250/296 |
| 4,507,555 | March 1985 | Chang | 250/281 |
| 5,179,278 | January 1993 | Douglas | 250/290 |
| 5,331,158 | July 1994 | Dowell | 250/282 |
| 5,420,425 | May 1995 | Bier | 250/292 |
| 5,652,427 | July 1997 | Whitehouse et al. | 150/288 |
| 5,689,111 | November 1997 | Dresch et al. | 250/287 |
| 5,763,878 | June 1998 | Franzen | 250/292 |
| 5,811,800 | September 1998 | Franzen et al. | 250/288 |

OTHER PUBLICATIONS

Ooms, B., Temperature Control in High Performance Liquid Chromatography, LC-GC (Asia Pacific), vol. 1, No. 1, p. 27-35 (1998).

Lin, H. Y., Voyksner, R. D., Analysis of Neuropeptides by Perfusion Liquid Chromatography/Electrospray Ion-trap Mass Spectrometry, rapid Communications in Mass Spectrometry, vol. 8, p. 333-338 (1994).

Chien, B. M., Michael, S. M., Lubman, D. M., Plasma Source Atmospheric Pressure Ionization Detection of Liquid Injection Using an Ion Trap Storage/Reflectron Time-of-Flight mass Spectrometer, Analytical Chemistry, vol. 65, p. 1916-1924 (1993).

Boyle, J. G., Whitehouse, C. M. and Fenn, J. B., An Ion Storage Time-of-Flight Mass Spectrometer for Analysis of Electrospray Ions, Rapid Communications in Mass Spectrometry, vo. 5, p. 400-405 (1991).

Grix, R., Grüner, U., Li, G., Stroh, H., Wollnik, H., An Electron Impact Storage Ion Source for Time-of-Flight Mass Spectrometers, International Journal of Mass Spectrometry and Ion Processes, vol. 93, p. 323-330 (1989).

RIGHTS TO THE INVENTION

The work leading to this invention was conducted under research sponsored by the United States National Institutes of Health. The US government shall therefore have the right to practice this invention.

BACKGROUND OF THE INVENTION

This invention relates to mass spectrometers and their ability to multiplex between simultaneously arriving and discrete sample streams without incurring either sample loss or intra-sample mixing. It concerns itself with the issue of maximizing sample throughput on a mass spectrometer by creating parallel sample introduction and transmission paths, while at the same time ensuring that no mixing of the individual sample streams occurs. In this manner, chemical data are uncompromised in terms of cross-stream contamination, while the overall sample throughput is increased substantially.

This invention is applicable to any mass spectrometer which depends upon batch-wise introduction of samples for performing mass analysis, including but not limited to time-of-flight mass spectrometers (TOF-MS), fourier transform ion cyclotron resonance mass spectrometers (FT-ICR-MS), and three dimensional ion trap mass spectrometers (IT-MS). Time-of-flight mass spectrometers are best suited to exploit this parallel introduction invention because of their inherent ability to process discrete samples on a millisecond time basis or faster. While FT-ICR-MS and IT-MS systems require greater periods of time to acquire high quality mass spectrometric data, these systems could also make use of this invention to improve sample throughput. Commercial FT-ICR-MS systems are currently capable of generating mass spectra at a rate of approximately 50 Hz. While several orders of magnitude lower than TOF-MS systems, this acquisition rate would still permit use of the invention with multiple sample streams, given that these streams could be sampled frequently enough to reflect any temporally dynamic sample concentrations present.

This invention is applicable to any mass spectrometer with an external ion source, and is particularly useful when this ion source produces analytically important ions continuously over extended periods of time. Examples of external ion sources which can produce ions continuously include electrospray ionization (ES) and atmospheric pressure chemical ionization (APCI), both of which may be coupled to liquid chromatography (LC) in order to first temporally separate different species prior to MS interrogation. When coupled to LC or other chemical separation instruments, ES and APCI ion sources generate ions from a temporally dynamic stream of analyte molecules, ranging in duration from seconds (for very fast separations) to several hours (for very long separations).

A fundamental principle of time-of-flight mass spectrometry is the extraction of a closely packed ensemble of ions formed at time zero. These discrete ensembles of isoenergetic and spatially coherent ions are accelerated from an extraction region and into a field free flight tube for longitudinal separation based upon their different (constant) velocities and hence mass-to-charge ratios. Ions created outside the extraction region may be injected into the extraction region, such as from an atmospheric pressure ion source or glow discharge source. Alternately, ions may be created within the extraction region from neutral molecules, for instance by using a pulsed beam of photons, electrons or ions. In either case, only those ions that are in the extraction region at the moment the starting pulse is applied are analytically useful, as only these ions will be imparted with the proper energy to be detected and properly characterized after field-free flight.

Given this constraint, the direct coupling of a continuously operating ion source to a time-of-flight mass spectrometer suffers from an inefficient use of the ions created. While one may apply start pulses to the time-of-flight mass spectrometer at frequencies which match the characteristic time required to re-fill the extraction region from an external supply of ions, duty cycles may still be far from unity under certain conditions.

A solution to this mismatch caused by interfacing a continuous ion source and a batch processing method such as time-of-flight mass spectrometry has been described by Dresch et. al. (1996). In order to make use of the greatest fraction of ions generated as possible, a multipole ion guide is inserted at the appropriate location between the ion source and the extraction region to store ions between consecutive start pulses. Owing to the fact that it is a two dimensional device spanning multiple pumping stages, this device can deliver ions to the extraction region either as a continuously transmitting ion guide or as a pulsed two dimensional ion trap. In contrast to three dimensional ion traps described by Lubman (ref) and Douglas (ref), this two dimensional ion trap can hold a far greater number of ions within its volume before reaching an experimentally observed critical density. Critical density is characterized in practice by the observation of mass spectral signals which may be reduced in amplitude, or different due to catastrophic ion fragmentation, or improperly focussed at the detector due to greater internal energies, or some combination of the above. For a given flux of ions being delivered from an external ion source, the higher charge capacity of this two dimensional ion trap allows storage of ions for more time. This is of the utmost importance to the present invention in affording adequate time for sequentially introducing multiple independent samples through a single time-of-flight mass analyzer without loss of information on the chromatographic timescale.

Ionization methods such as electrospray and atmospheric pressure chemical ionization are utilized regularly to ionize liquid samples containing non-volatile compounds of interest, including but not limited to peptides, proteins, pharmaceutical compounds and metabolites.

The sensitivity, specificity and selectivity of API-MS have made it an essential research tool in the life sciences and pharmaceutical development, in which the analytical performance of API-MS systems has most often been categorized in terms of limits of detection, mass resolving power, mass accuracy, and mass-to-charge range. Previously, little if any regard was paid to issues relating to automation.

Spurred on over the last several years by pharmaceutical development methods, strictly analytical performance metrics have been joined by automation metrics.

Automation of analytical tests such as API-MS afford one or more advantages over manual operation, including:

- Reduced labor
- Reduced expertise of labor
- Higher sample throughput
- Better utilization of capital instruments
- Better analytical reproducibility (as measured by the relative standard deviations from sample to sample)

As an example, the automation of API-MS now allows previously untenable sample sizes to be more rapidly analyzed, thereby supporting technologies such as combinatorial chemistry which require very large sample sizes to isolate a compound of interest.

As a result, there have been considerable advances in automating the operation and data collection of API-MS instruments both at the hardware and especially the software levels. The latter case is best exemplified by the introduction of Open Access standards for non-expert users. The former case is best illustrated by the introduction of multiple injector autoinjectors such as the Gilson 215 instrument (Madison, Wis.). What has been lacking are the means to accelerate the throughput Within the last several years, there has been increasing interest in coupling these continuous ionization methods to time-of-flight mass spectrometry in order to achieve certain performance characteristics which would be otherwise unattainable. These include but are not limited to high mass accuracy, high mass-to-charge detection, quasi-simultaneous detection of the entire mass-to-charge domain, high pulse rates, high sensitivity, and fewer tuning requirements than scanning type mass analyzers.

Collectively, these features make time-of-flight mass spectrometers ideally suited as detectors for temporally changing sample streams. Moreover, the ability to couple liquid separation systems directly to atmospheric pressure ionization sources such as electrospray ionization and atmospheric pressure chemical ionization allows for on-line processing of these separations without the need to collect chromatographic or electrophoretic fractions for off-line processing. In fact, the sampling rate of atmospheric pressure ionization time-of-flight mass spectrometers with ideal data system architectures can generate complete mass spectra with adequate ion statistics in far less than 1 second. This speed of acquisition allows faster liquid separation protocols to be designed and implemented which slower, scanning types of mass spectrometers could hot record with adequate chromatographic fidelity.

The desire to introduce multiple samples into a single mass analyzer stems from a combination of factors. Technically, time-of-flight mass spectrometers are fast enough in "scanning" a useful mass range that multiple samples can be completely characterized even when these samples are themselves temporally dynamic (as in the case of a liquid chromatogram). For instance, the vast majority of liquid samples separated by reversed phase chromatography will exhibit LC peak widths on the order of several seconds or more. This is ample time for a single TOF-MS to mass analyze several samples, given its ability to form complete mass spectra in as little as 100 microseconds or less.

This multiplexing capability is inviting for those who wish to (a) achieve higher capacity utilization, (b) lower capital costs, (c) shrink total required laboratory space, (d) centralize data handling and (e) minimize hardware maintenance.

There are a number of important works which define the state of the art as it relates to this patent application. These works involve the development of plural ions, parallel mass spectrometers, and ion storage using two dimensional ion traps. The use of plural ion beams in either single or parallel mass spectrometer has been demonstrated by a number of inventors and for a number of distinctly different reasons. Green in U.S. Pat. No. 3,740,551 demonstrated parallel mass separation and detection of different ion beams simultaneously, principally as a means of performing both high and low resolution mass spectral scans on magnetic sector type instruments. These ion beams could originate from either a single chemical sample or from a sample and a reference compound which was used to calibrate the mass scale of the instrument. In U.S. Pat. No. 3,831,026 Powers taught the use of a time division multiplexing apparatus, which sampled alternate ion beams for mass separation and detection in an interleaved fashion. This multiplexing apparatus consisted of either a pair of plates at controlled voltages or a continuously transmitting hexapole ion optic. By overtly controlling the portion of time that each ion beam was sampled, relative intensities of the two beams could be better managed for greatest analytical utility. Chang was among the first to recognize the utility of plural beams and parallel mass spectrometers in analyzing temporally dynamic samples from either gas chromatography (GC) or liquid chromatography (LC) in U.S. Pat. No. 4,507,555. Like the aforementioned inventors, parallelism was sought as a means of extracting different types of mass spectrometric data from a single sample, especially in circumstances when rapidly eluting compounds made it difficult or impossible for a slow scanning quadrupole MS to keep pace. One quadrupole was used to monitor a single target mass-to-charge of interest, as well as to trigger full mass range acquisitions by a second quadrupole should the target ion appear. This improved detectability over full mass range survey scans by a factor of 100. Using time-of-flight as the preferred mass separation scheme, Dowel in U.S. Pat. No. 5,331,158 demonstrated the ability to achieve 100% duty cycle of a flight tube (not an individual chemical sample) by injecting ion packets from multiple electron impact ion sources in rapid succession to one another.

Several important patents have been issued in the area of two dimensional ion guides and ion traps, all of which teach important aspects of the science which underpin this patent application. Douglas in U.S. Pat. No. 5,179,278 taught that two dimensional multipole ion guides were highly effective devices for trapping and storing off-cycle ions until a three dimensional ion trap mass spectrometer had completed its analysis of the previous ion bunch. Both pre-selection and collisional cooling of the stored ions were described as advantageous features. Bier in U.S. Pat. No. 5,420,425 furthered this argument by demonstrating the relative analytical advantages of two dimensional ion traps in terms of their storage capacity, circumventing the charge limitations which less stretched ion traps necessarily suffer due to space charge constraints. Both Whitehouse in U.S. Pat. No. 5,652,427 and Dresch in U.S. Pat. No. 5,689,111 describe the use of a multistage two dimensional ion guide as an appropriate ion storage device to feed batch-wise mass spectrometers, including time-of-flight, ion trap and Fourier Transform Ion Cyclotron Resonance type systems. These patents taught the use of enhanced collisional cooling by close coupling a multipole ion guide to the free jet expansion of an atmospheric pressure ionization source. In this way, ions could more effectively be captured while still experiencing viscous forces in the high pressure region of an atmospheric pressure ion source. After capture, their cooling and transport to a much lower pressure region would ensure a much more monoenergetic ion beam which was better suited for injection into energy sensitive MS systems, especially TOF-MS. Franzen in U.S. Pat. No. 5,763,878 extends the multipole ion trap functionality by both trapping ions within the device and using it as the ion source of an orthogonal TOF-MS. Most recently, in U.S. Pat. No. 5,811,800, Franzen generates bunches of stored ions from an atmospheric pressure ion source using RF coils, this time for the purpose of feeding a three dimensional ion trap MS system.

The ability to introduce different samples from different separation systems into a single time-of-flight mass spectrometer was recently introduced by Micromass, Inc. In this design as many as four different liquid streams are multiplexed, with sample selection occurring at atmospheric pressure. This concept is commercially advantageous insofar as it makes use of a standard LC-TOF-MS, requiring no modification of the vacuum system or ion optics to work. However, since all four liquid streams flow continuously, the selection of any one stream necessarily imposes a duty cycle limit dictated by the number of streams sampled. For those streams which are "off-cycle" (i.e. not sampled) any analytical information contained in the off-cycle portions of those liquid streams is lost and can not be recovered. For a large number of applications currently in practice involving high concentrations of synthetically derived small organic libraries, analytical sensitivity is not of paramount concern. Nevertheless, this approach is analytically disadvantageous in circumstances in which sample amounts or concentrations are especially low. Proteomics, including both general molecule characterization as well as peptide sequencing, is a critically important field for which analytical sensitivity is paramount, especially in applications being reduced to nanoscale dimensions for both separation processes ("lab-on-a-chip") and mass spectrometry (nanoelectrospray).

The present invention arises from the need to mass spectrometrically characterize larger numbers of distinct samples than is currently possible, but without requiring multiple independent mass spectrometers. This analytical need is driven in large part by the adoption of combinatorial chemistry methods by pharmaceutical researchers, who today are the largest and one of the fastest growing segments of the mass spectrometry market worldwide (Strategic Directions International, 1996). Due to this shift towards combinatorial chemistry and away from slower, rational drug design programs, the number of compounds which are being regularly generated and which require positive identification via mass spectrometric analysis has risen dramatically (Doyle, 1995). This trend is expected to continue for years to come (Hail, 1998).

In the field of functional genomics, the ability to identify and characterize gene products (proteins) with vanishingly small amounts of material using mass spectrometry will be essential. Standard separation tools in existence today, including two dimensional electrophoresis, can both separate and detect proteins in amounts far below the detection limits of any mass spectrometer (Ref). While more abundant proteins are easily detected, a large portion of all the proteins contained in mammalian cells exist in copy numbers below the present day capabilities of dedicated, research grade mass spectrometers. Since many of these low abundance proteins are likely to have important regulatory functions in cells, their efficient detection using appropriate staining techniques and their subsequent digestion and analysis using mass spectrometry is vital. (Herbert, Proteome Research: New Frontiers in Functional Genomics). This need is exacerbated by the fact that the entire proteome complement of any organism is a function of age, heredity, wellness, and environmental conditions. Such a dynamic system requires analytical tools which can monitor an organism at various stages of its lifetime. This scarcity of sample will limit the future effectiveness of "lossy multiplexing", i.e. the use of multiple sample streams multiplexed to a single mass spectrometer with duty cycle limits.

Briefly, syntheses of combinatorially created compounds with potential therapeutic value are carried out using small sets of related starting materials. These sets cover the physical chemical parameters that are required to optimize the properties associated with a pharmaceutical agent, such as good oral bioavailability and in vivo stability. The library or array which results from all possible combinations of these starting materials may be very large in an attempt to cover an appropriate property space, ranging in size from several hundred to several hundred thousand distinct compounds. The complete library or some portion of it which meets certain preliminary screening criteria (the presence or absence of a fluorescence signal, for example) may require complete chemical characterization, usually by mass spectrometry. Because each of the nominal library constituents may be a mixture of the intended product, side-products, reactants, and impurities from various sources, mass spectrometry may be employed in conjunction with a separation method such as liquid chromatography (LC-MS) to separate in time these various components. By separating the individual components within a reaction volume, components elute separately into the ionization source and MS system, generating a mass chromatogram of total ion current versus time. This both simplifies analysis of the data and optimizes the response of the MS system for each constituent by maximizing the ionization efficiency (i.e. minimizing charge competition).

While the chemical specificity of an LC-MS system is greater than using an MS system in the absence of liquid chromatography, there is a time penalty associated with performing an LC separation, reducing the highest achievable sample throughput. The alternative and faster method of analyzing individual liquid samples is by flow injection analysis MS (FIA-MS), infusing liquid samples directly without chromatographic separation.

While the maximum rate at which samples can be sequentially analyzed using either FIA-MS or an LC-MS varies depending upon the specific protocol being followed, in general FIA-MS typically requires between tens of seconds and a minute per sample, depending upon the specific autoinjector hardware being used and the stringency of the inter-sample rinsing. Users in high throughput settings have demonstrated the ability to analyze as many as 1000 samples per mass spectrometer per day in this manner. The primary drawback to this approach is the aforementioned uncertainty in ionization efficiency in the presence of possible impurities. In instances in which the mass spectrometric response is being used as an indicator of the presence or absence of an expected product, the quality of the mass spectrometric data are vital in judging the utility of a particular library compound. Typically one looks for an expected molecular ion of mass $M_1$ to verify synthesis confirmation. If this expected mass is obscured or suppressed by the presence of an impurity with a greater proton affinity of mass $M_2$, then the mass spectrum generated by flow injection MS may not reveal the presence of the target product. However, if the liquid solution containing both of these species is first separated by liquid chromatography or some other appropriate separation which can partition the compounds based upon their physical or chemical properties, then the resultant mass spectra may likely reveal the presence of each of these constituents. In the LC-MS mode, protocols specifically designed for rapid separation of small molecules typically require between 5 and 15 minutes, an improvement over traditional 30-60 minutes gradients used before the advent of high throughput screening but still orders of magnitude slower than other non-mass spectrometric assays. Recently, Banks (1996) demonstrated more rapid separations of complex mixtures in reversed phase LC-MS using both normal bore (4.6 mm ID) and microbore (320 mm ID) columns packed with small uniform spheres of non-porous silica. Separations of 2-3 minutes were typical, demonstrating both high throughput and very high chromatographic resolution. These faster runs were specifically designed to exploit the ability of a time-of-flight mass spectrometer to handle very high data rates. In practice, the compression of chemical separations and the sub-second generation of mass chromatograms by time-of-flight mass spectrometry is the chemical analog of high speed electronic waveform capture, requiring both the means to generate and record events (ions) at the high megahertz to gigahertz frequencies. For this reason, high speed separations coupled to MS have been labelled "burst mode" systems (Banks, 1995). Representative of the current state of the art in high throughput LC-MS, this work clearly shows that radical (order of magnitude or more) improvements in LC-MS throughput, even with specialized chromatographic methods, are not easily obtained when operating in a strictly serial fashion. In order to overcome the sample throughput limitations described here and summarized in Table 1, one of two approaches must be adopted.

First, additional LC-MS instruments, each operating in a serial fashion, could be brought on-line to increase throughput in a strictly linear fashion. This requires a proportionate expenditure of capital and expense funds to purchase and operate multiple machines, as well as requiring multiple computer systems to run the instruments and acquire and analyze data.

Second, multiple separation systems could be coupled in-turn to a single mass analyzer, allowing an LC-MS run to proceed with one LC system while a second LC system is re-equilibrated and a new sample prepared and injected. Such a system has been integrated by the Micromass Division of Waters Corp. for high throughput applications on quadrupole based LC-MS systems. Such an approach is a cost effective means of improving specific sample throughput (in terms of samples per unit time per dollar of realized capital expense), and derives the maximum benefit possible from the relatively expensive mass spectrometer and data system. However, there are two significant limitations. First, the net sample throughput operating two LC systems coupled to a single mass analyzer with a single ion source is far less than two LC-MS systems operating independently. That is, the time savings per sample is approximately equal to that fraction of the time that a single LC system spends re-equilibrating and injecting a new sample onto the column (Figure N).

Third, multiple LC systems could be run in tandem and samples from each be sampled by the MS in turn, using either liquid flow valves or alternating ionization probes to achieve a multiplexing of samples in a single mass analyzer. In the absence of true sample storage, those LC streams which are not being sent to the mass analyzer at any instant in time are being sent to waste. Therefore, this time-slicing approach suffers from the fact that by reducing the duty cycle of each effluent stream, the mass analyzer will be rendered blind to peaks which occur off-cycle. In light of higher speed and higher plate count methods now coming into wider practice, there would be an unreasonably high risk of sending to waste complete peaks which would escape mass spectrometric detection.

The desire to accommodate multiple samples simultaneously in order to achieve higher sample throughput stems in large measure from the growth of combinatorial chemistry. The Biotage Corp. of Charlottesville, Va. produces a product called Parallex HPLC, intended to allow four samples to be chromatographically separated simultaneously. In order to interface these four separate and discrete liquid streams to a mass spectrometer currently, the four streams are routed through a rotary valve which serially introduces each of the four streams to a mass spectrometer's ionization source. In order to prevent stream-to-stream mixing, a bolus of make-up solvent (a "blank") is introduced into the flow in between consecutive analytical samples. For four separate liquid streams represented by A, B, C, and D, and the make-up solvent represented by S, the sequence of sample delivery to the mass spectrometer will be ASBSCSDSASBSCSDSASBSCSDS . . . . This necessarily implies that the maximum duty cycle achievable for any one of the liquid streams is limited to the portion of time it is actively being sampled, which is one-eight of the total experiment time or 12.5%. For the other 87.5% of the time, those streams which are "off-cycle" are not accumulated, but rather are discarded as waste. The time interval required to sample all four liquid streams is on the order of 1 Hz. There are two limitations in coupling such a system to mass spectrometry in order to achieve higher sample throughput. One difficulty is the immediate loss in sensitivity due to the duty cycle limit. Moreover, multiplexing the samples in the liquid phase exacerbates this problem due to the need to introduce inter-sample blanks. The second difficulty is the inability of the multiplexer to select any given liquid stream at a rate greater than 1 or several Hz. Driven by the need to analyze samples ever faster, the clear trend in chromatography is towards faster, higher resolution separations (Ooms). In many cases, separation protocols are now being developed which require only several minutes even for complex mixtures, with eluants exhibiting peak widths of several seconds or less. In instances such as this, mass spectrometric sampling of individual chromatographs at one or several. Hz will be inadequate to recreate with any acceptable fidelity the underlying separation. In practice, it is desirable and in many cases required to sample such chromatographs at a rate far higher than the typical elution time of a peak. Typically, sampling the chromatograph at a rate 10 or more times faster than the eluant peak width is acceptable to accurately describe the peak and its fine structure.

The present invention mitigates this time penalty by allowing the simultaneous introduction of more than one liquid separation to the MS system. Furthermore, because of the ion storage feature of the invention, no loss of chromatographic fidelity is incurred, even for chromatograms exhibiting narrow peak widths. This is especially advantageous since high throughput screening applications favor separation systems which can operate at high linear velocities and/or with high numbers of theoretical plates, both of which lead to narrow peaks which could otherwise elute undetected in the absence of ion storage.

One previously described method switches between multiple liquid streams flowing to a single spray assembly for ionization, consecutively valving to waste all but one of the streams at any instant in time (Coffey ref). Because of valve mechanics, this sample selection process is limited in the highest frequency it can operate at while preserving analytically important reproducibility, and moreover creates temporal gaps in the mass chromatograms of the off-cycle streams which may contain analytically important information. Another previously described method advocates the use of multiple ionization assemblies each delivering its distinct sample stream in sequence to a single vacuum orifice. Gating of the individual ionization assemblies may occur by modulation of a combination of: (1) electric potential to the spray probe; (2) pneumatic gas pressure and flow to the spray probe; (3) gas pressure, flow and orientation to the countercurrent bath gas; and/or alignment and positioning of the individual spray probes with respect to the vacuum orifice.

Making use of the high sampling rate of the time-of-flight electronics and the storage capabilities of two dimensional multipole ion traps. In this manner, more than one liquid handling system can continuously infuse its effluent or other the simultaneous introduction of multiple sample streams to multiple atmospheric pressure ionization spray assemblies.

BRIEF SUMMARY OF THE INVENTION

An object of the present invention is to use a single mass spectrometer to analyze ions from multiple atmospheric pressure ion sources while satisfying the following two constraints: (1) ion beams from each of the discrete and separate ion sources are not mixed with one another, thereby retaining the true chemical profile of each of the analytical samples; and (2) essentially all ions from each of the ion beams are used for mass spectrometric analysis in turn, regardless of the number of separate ion beams.

A further object of the invention is to achieve substantially higher sample throughput on a single mass spectrometer, without mixing the individual analytical samples and without gating various samples in such a way that duty cycle and hence sensitivity might be compromised.

The means by which this improved sample throughput may be obtained is to employ parallel ion paths and ion storage within the ion optics leading into a single mass spectrometer. Parallelism is exploited by introducing multiple discrete samples through separate and distinct sampling ports, transmitting these ions to separate and distinct ion storage devices, and sequentially gating these separate and distinct ion populations into a single flight tube or other mass analysis device (cyclotron cell, ion trap, etc.) in turn. In this manner, only one set of mass analyzing hardware and electronics are needed to process multiple sample streams, and a user may arbitrarily start or stop experiments on any of the various sampling ports without regard for the experiments being conducted on other unrelated sampling ports. The signals recorded from each of the sample streams are written to different device channels or memory locations, to keep separate and distinct the data associated with each of the aforementioned streams. In this manner, the overall sample throughput which a single mass spectrometer can support will far exceed that of a mass spectrometer coupled to a dedicated single ion source. Lastly, this multiplexing approach in no way compromises the analytical figures of merit which may be obtained for any given sample when compared to a mass spectrometer coupled to a dedicated single ion source.

This invention has several advantages over existing solutions for obtaining mass spectrometric data from atmospheric pressure ionization sources coupled to liquid chromatographs. The existing solutions can be characterized as one of the following: (A) dedicated, (B1) liquid multiplexed, or (B2) ion multiplexed at atmospheric pressure. The present invention constitutes a new and a fourth type of multiplexing, namely (B3) ion multiplexed in vacuo. The properties of these four types of sample introduction systems are shown in Table 1. For mass spectrometers which mass separate ions in a batch-wise fashion (such as TOF, FT-ICR and ion traps) discrete samples created in parallel must be submitted serially, lest mixing of multiple unrelated samples occurs. A timing device is therefore required to multiplex these samples in an orderly and analytically useful fashion.

The timing of multiple analytical samples originating from separate liquid sample streams, ionized by an atmospheric pressure ionization process and delivered into a vacuum system for mass spectrometric analysis may occur in one of three regions. These regions include (a) in the liquid streams themselves, prior to nebulization and ionization, (b) the atmospheric pressure region of an ionization source or (c) in vacuum. For all of these multiplexing strategies one may attain higher throughput than would otherwise be possible using a strictly serial methodology (of one sample introduced to one ion source coupled to one mass spectrometer). However, unlike the other strategies, gating in vacuum affords several features which are analytically useful and unique. The first of these features is the ability to accumulate off-cycle sample (ions) in an ion storage device, thereby preserving the analytical sensitivity of the system for the compound at hand. The second of these features is very short switching time. For circumstances in which one wishes to switch the output of ions from one RF ion guide from "OFF" to "ON" or vice versa, this switch is completed in tens of nanoseconds, a timescale so fast that one may invoke multiple ion guides to switch multiple times every second without significant loss of duty cycle. This second feature is critically important for the invention to service multiple sample streams which may be highly dynamic in nature, such as high speed chromatography exhibiting characteristic peak widths of a second or less in duration. Exacerbating the sampling demand, one may wish to mass spectrometrically analyze several such liquid chromatographs simultaneously, each requiring the acquisition of multiple mass spectra every second. If these chromatographs are all high resolution (i.e., have temporally narrow peaks) and are rapid in nature (multiple peaks occurring in a short period of time) then it is essential that each of these chromatographs be frequently sampled by the mass spectrometer to achieve high chromatographic fidelity, preferably at a rate 5-10 times greater than the typical chromatograph peak width. Unlike other gating strategies shown in Table 1 which must overcome significant time lags while switching between sample streams to accommodate the working fluid (air or liquid solvent), invoking an ion gate in vacuum is essentially instantaneous. This therefore allows one to switch more frequently, which in turn allows one to monitor a larger number of discrete sample streams with adequate fidelity. In contrast, switching between liquid samples using a valve must be done at frequencies of approximately 1 Hz or less in order to avoid excessive carry-over from stream to stream. Also in contrast to the present invention, switching between continuously operating ion sources at atmospheric pressure will require one to several seconds to accomplish, since these partly gaseous, partly liquid sprays needs this time interval to stabilize (i.e. begin to deliver analyte ions to a vacuum orifice) in response to either electrical and/or mechanical shutters.

Compared to dedicated mass spectrometer systems (A) which employ one ion source interfaced to one mass spectrometer, the subject invention (B3) and other described multiplexing strategies (B1, B2) deliver a total sample throughput which is N times greater, where N is the number of discrete sample streams being sampled for mass spectrometric analysis. But because methods B1 and B2 offer no means of storing "off-cycle" sample streams until the mass analysis device has completed its previous analysis, these strategies necessarily lead to loses in duty cycle and hence analytical sensitivity. For applications requiring high sensitivity, especially those requiring the detection and characterization of very trace substances such as peptides or metabolites, such sensitivity losses may be unacceptable. In contrast the present invention risks no loss of off-cycle information. As an example of multiplexing using strategy B1, Biotage (Ref) has demonstrated a commercial instrument which sequentially samples N chromatography streams and delivers the time-sliced output to a mass spectrometer. The disadvantage of this solution is that any chromatographic effluent of importance which arrives at the sampling valve "off-cycle" is immediately discarded as waste, thereby degrading the analytical sensitivity of the instrument in direct proportion to the number of streams sampled, potentially missing important chemical data altogether. In addition, the speed with which the Biotage system can switch between sample streams (1-3 Hz) precludes its use for fast chromatographic applications with peak widths of several seconds or less. Micromass, Inc. has commercialized a multiplexing version of its TOF-MS product, which uses strategy B2 to switch between different ion sources at atmospheric pressure. Like the Biotage solution, it too suffers from duty cycle loss, with sensitivity degrading in direct proportion to the number of streams sampled. Also like the Biotage solution, the characteristic time to switch between sample streams is limited by the working fluid, in this case air or nitrogen, to several Hz or less. While ions are continuously generated by several different spray assemblies, each assembly when selected for MS sampling must be given adequate time for its spray plume to react to the electrostatics at atmospheric pressure and deliver an adequate number of analyte ions into vacuum.

In sharp contrast, the present invention may be switched at least as frequently as 1000 Hz, which is suitably fast to detect many dynamic sample streams with adequate chromatographic fidelity. This switching capability makes it ideally suited for a growing number of chromatographic protocols designed for high throughput and high resolution, especially "lab-on-a-chip" based designs.

BRIEF DESCRIPTION OF THE DRAWINGS

Table 1 is a tabular comparison of typical sample throughput rates for (1) flow injection analysis (FIA-MS), (2) LC-MS, (3) fast LC-MS using accelerated separation methods, and (4) parallel LC-MS using the present invention.

DETAILED DESCRIPTION OF THE INVENTION

Figure 1:
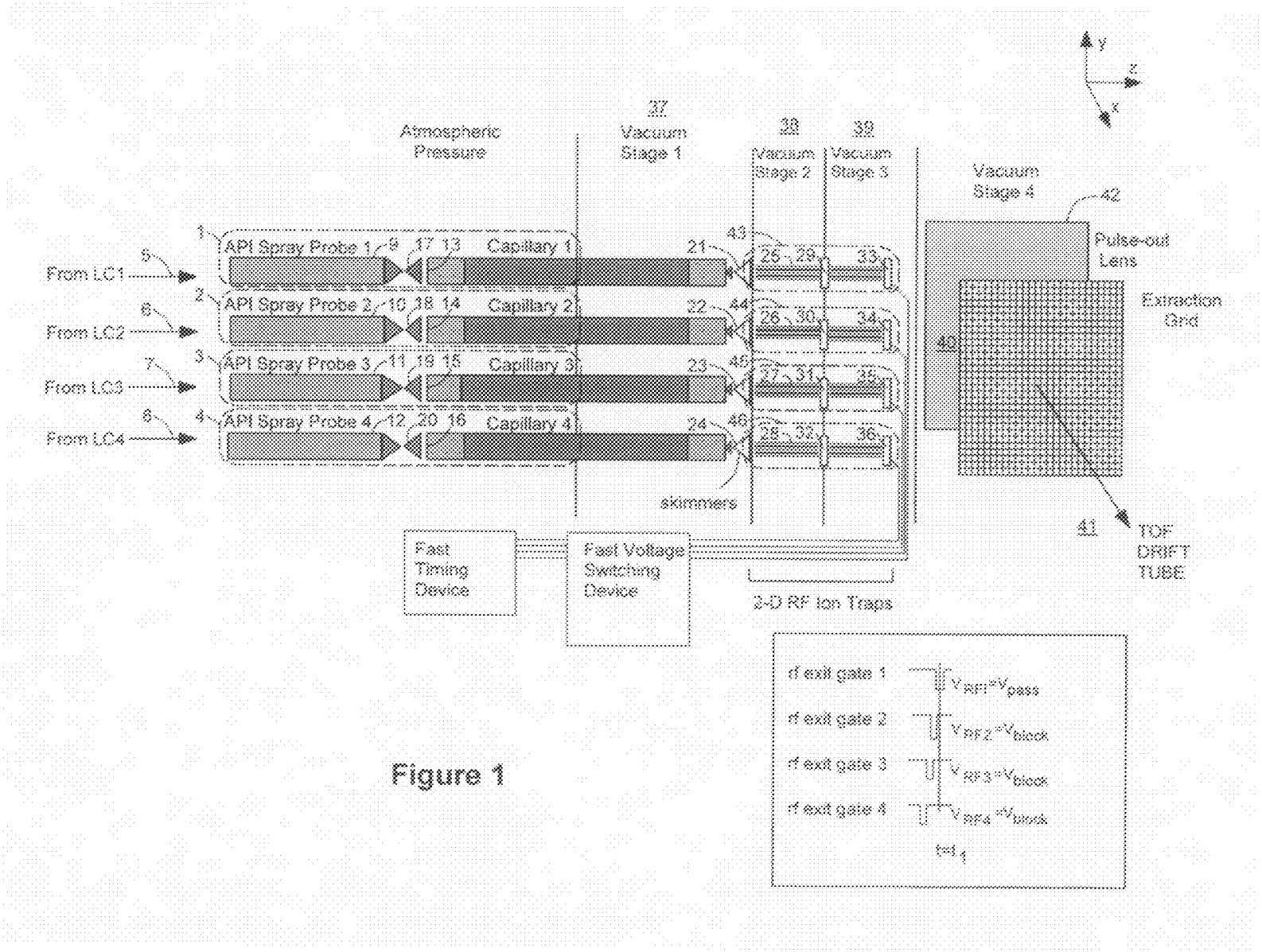
FIG. 1 is a schematic representation of a plural source mass spectrometer.

FIG. 1 shows an arrangement for conducting mass spectrometric analysis on multiple ion sources 1, 2, 3, 4 using a preferred embodiment of the invention. In this case a number of samples are simultaneously injected onto the same number of liquid chromatography columns for separation of their individual constituents. Each of these sample streams 5, 6, 7, 8 elute and are transferred in line to its own atmospheric pressure ionization source 1, 2, 3, 4. These API ion sources 1, 2, 3, 4 are oriented to allow high transfer efficiency of ions between each ionization probe 9, 10, 11, 12 and its respective vacuum orifice 13, 14, 15, 16. Likewise, each of these sprayer-orifice pairs 9&13, 10&14, 11&15, 12&16 is set a suitable distance apart to prevent the migration of ions from, for example, probe A 9, e.g. towards orifice B 14, e.g., Which would lead to erroneous mass spectral data in mass spectrum B by falsely indicating the presence of a compound from chromatograph A. Each of the API devices 1, 2, 3, 4 converts its respective sample stream 5, 6, 7, 8 into charged particles which are suitable for transfer into a vacuum system containing a time-of-flight mass spectrometer. Transfer of each ion packet into this common vacuum system is accomplished by focussing these ion packets through a vacuum orifice 13, 14, 15, 16 and towards an ion optical system containing at least one two dimensional ion trap 43, 44, 45, 46 for storage and transmission purposes. Because different ion packets from different samples are prevented from co-mingling within the injector portion of the instrument, cross contamination of the various samples is therefore avoided.

While a chromatograph is running, ions from each chromatograph are continuously admitted into the vacuum system, being focussed into their respective two dimensional ion guides 25, 26, 27, 28. At no point in time is the influx of charged particles to any two dimensional ion trap 43, 44, 45, 46 turned off, since this would represent a loss in chemical information. Outflux from the ion traps 43, 44, 45, 46 is allowed serially, the frequency and duration of which are dictated by different factors. This multiplexing of different ion packets from different chromatographs into a single TOF mass spectrometer allows one to simultaneously analyze a number of different samples 5, 6, 7, 8 on a single data acquisition system 101 and data analysis package. This centralized processing allows a single operator to inspect large numbers of records without relying upon a network to connect multiple instruments.

Figure 2:
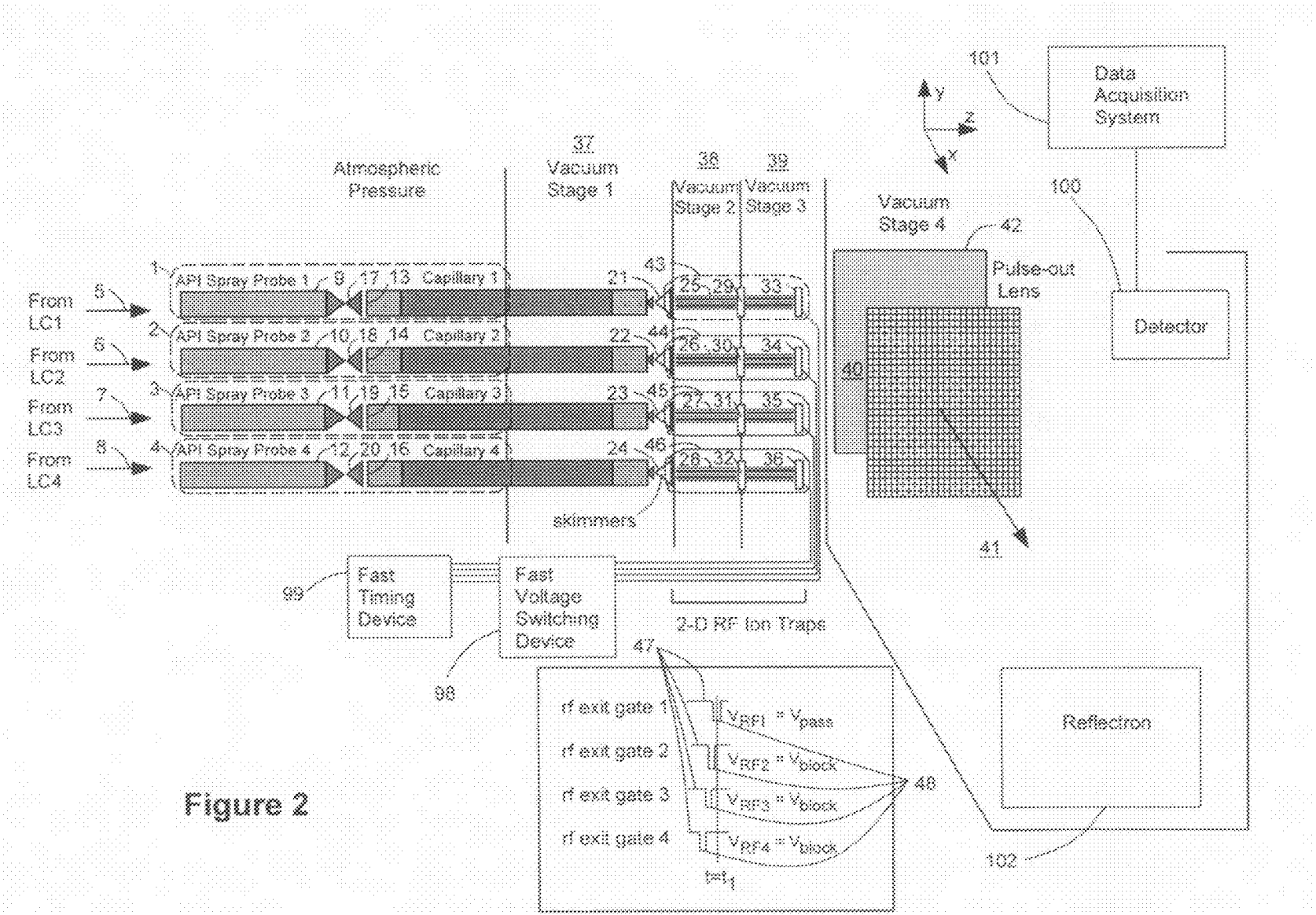
FIG. 2 is a schematic representation of a preferred embodiment of the invention, in which multiple atmospheric pressure ionization sources are coupled to a single time-of-flight mass spectrometer. Transmission and storage of ions from each sample stream is accomplished using multiple two dimensional ion traps which serve to gate the ions into the flight tube in a serial fashion in order to generate unambiguous mass spectra.

A depiction of the specific ion optical elements to construct a preferred embodiment is shown in FIG. 2. First, liquid samples 5, 6, 7, 8 are delivered to atmospheric pressure ionization probes 9, 10, 11, 12 from liquid chromatography or other processes. These samples 5, 6, 7, 8 are converted into separate and distinct ion clouds 17, 18, 19, 20 by ionization probes 9, 10, 11, 12, which nebulize and ionize the streams 5, 6, 7, 8 in preparation for their admission into vacuum. The ions created from these streams are admitted into a common vacuum manifold through vacuum orifices 13, 14, 15, 16. A separate and distinct vacuum orifice 13, 14, 15, 16 is dedicated to each of the liquid sample streams 5, 6, 7, 8 to afford 100% duty cycle and no chemical cross-talk between the respective streams 5, 6, 7, 8. As the ions enter Stage 1 37 of the vacuum system, they are swept forward by a combination of gas dynamic and electrostatic forces through another vacuum orifice 21, 22, 23, 24 and into Vacuum Stage 2 38. As the ions enter Stage 2 38, they immediately enter a two dimensional multipole ion guide 25, 26, 27, 28, which serves to capture and collisionally cool the ions due to the high pressure at the trap's leading edge. These ions propogate forward due to the high influx of neutral gas molecules at the trap's upstream exit, contained radially all the while by the application of an appropriate RF potential on the poles of the device 25, 26, 27, 28. Since the multipole 25, 26, 27, 28 is a multi-vacuum stage device, after traversing a portion of the ion trap 43, 44, 45, 46 ions are again transmitted though another vacuum orifice 29, 30, 31, 32 into Stage 3 39. This differential pumping across the length of the two dimensional ion trap 43, 44, 45, 46 affords a very large pressure differential across the trap's length. In practice, this allows one to use the high pressure of the ion trap's upstream section for effective capture and collimation of ions with a broad translational energy distribution and the low pressure of the ion trap's downstream section for containment energy definition, storage and timed injection into mass spectrometers. Ions which accrue in each of the two dimensional ion traps 43, 44, 45, 46 are held within the trap and prevented from exiting the low pressure side by the application of a DC potential on an exit lens 33, 34, 35, 36. This exit lens 33, 34, 35, 36 may be held "high" 47 to trap ions or "low" 48 to allow ions to exit the trap 43, 44, 45, 46 as needed. When this exit lens 33, 34, 35, 36 is dropped from its "high" to its "low" state, ions which have accumulated within the two dimensional ion trap are caused to emit. A voltage switching device 98 controlled by an accurate timing device 99 is used to switch the voltage levels of the exit lens 33, 34, 35, 36. One or more ion optical lenses may be used between the exit lens 33, 34, 35, 36 and a mass spectrometer to best focus and transmit the ion packets forward into a mass spectrometer. When coupled to a time-of-flight mass spectrometer which employs orthogonal acceleration, it is particularly advantageous to deliver a packet of ions to the extraction region 40 of the TOF-MS which is monoenergetic, narrow in its spatial dimension (in the x-y plane) and with little or no velocity component in the axis of the TOF flight tube 41. As each of the two dimensional ion traps 43, 44, 45, 46 are pulsed out in turn, an appropriate time interval is allowed for the ion packets to arrive at the middle of the extraction region 40, whereupon a pulse-out lens 42 is then pulsed electrostatically to a suitably high voltage to cause orthogonal acceleration into a flight tube 40. The time of flight mass spectrometer may also include a reflectron 102 to compensate for energy distribution of ions.

Figure 5:
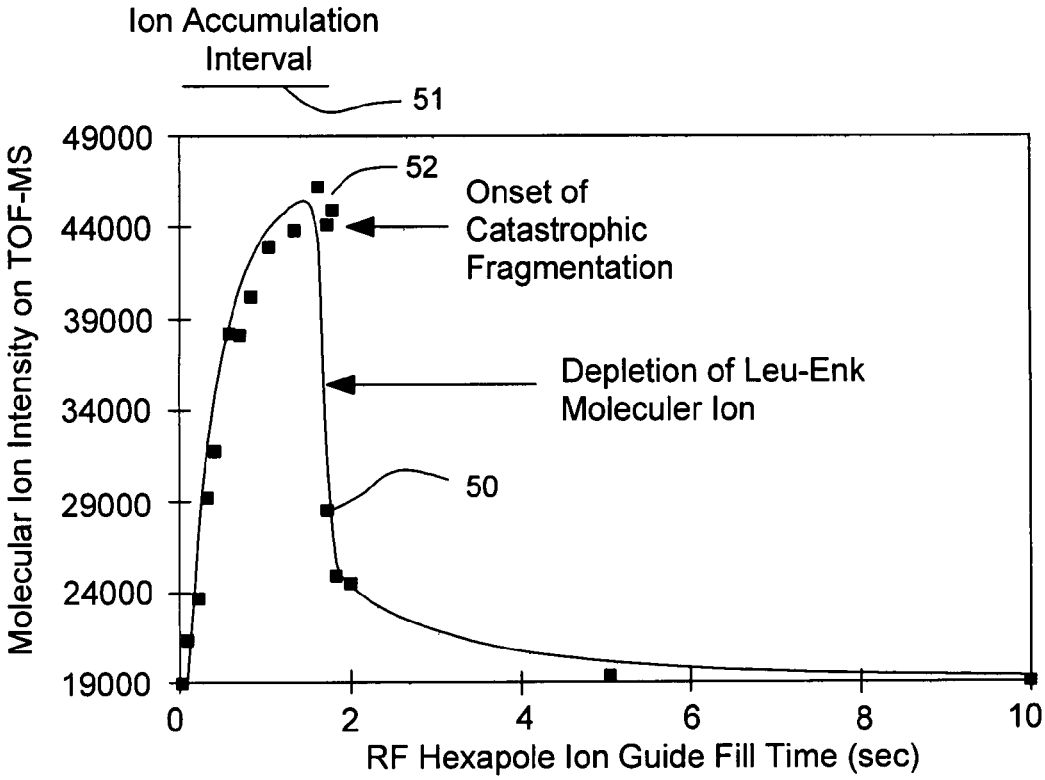
FIG. 5 shows the cumulative ion storage capacity of a single two dimensional ion trap monitoring the molecular ion signal observed (Leucine Enkephalin, MW 553.7) versus the total storage duration.

The timing associated with injecting multiple samples into a single flight tube 40 while incurring no loss in duty cycle for any given sample is strictly defined by the following parameters:

Number of chromatograms N arriving simultaneously;

Time interval $t_{trap}$ available for trapping;

Time interval $t_{flight}$ necessary for an ion packet to transit the flight tube 40; and Time interval $t_{emit}$ allowed for an ion packet to be pulsed out of the two dimensional ion trap 43, 44, 45, 46;

In practice, one will limit the time interval $t_{trap}$ to prevent overfilling of the ion trap 43, 44, 45, 46 with charged particles, since this has been shown to cause catastrophic fragmentation of the ions and loss of analytical information. In FIG. 5 evidence of this catastrophic fragmentation is evident. The molecule leucine-enkephalin is used to generate an electrospray ion beam, the ions within which are comprised primarily of leucine-enkephalin molecules and an attached proton. If a trap is first emptied, and systematically filled for different periods of time by controlling the ion source's and ion trap's electrostatic potentials, one may record the relative charge stored by inspecting the signal 50 associated with this molecule. For up to several seconds storage duration 51, the signal associated with this ion builds in intensity, until the charge density within the ion trap exceeds the critical density. Beyond this point 52 in time, the ion of interest falls precipitously in amplitude, signalling a rapid depletion due to space charge repulsion and ion ejection from the ion trap. Under most analytical conditions, one may trap ions from external atmospheric pressure ionization sources in two dimensional ion traps without suffering space charge effects and the aforementioned, fragmentation at rates as low as 2000 Hz for traps with internal volumes of approximately 2 $cm^3$ (70 mm length and 3 mm inner diameter).

In practice, one will also design the TOF-MS to separate ions over length scales and time frames which best suit the analytical figures of merit (mass accuracy, mass resolving power, and sensitivity). Given standard fabrication processes as well as electronics specifications, this generally entails a mass separation system which requires tens of microseconds or more to record an entire mass spectrum. For this reason, the choice of 100 microseconds as a benchmark time interval for $t_{flight}$ is reasonable for the preferred embodiment.

Figure 3:
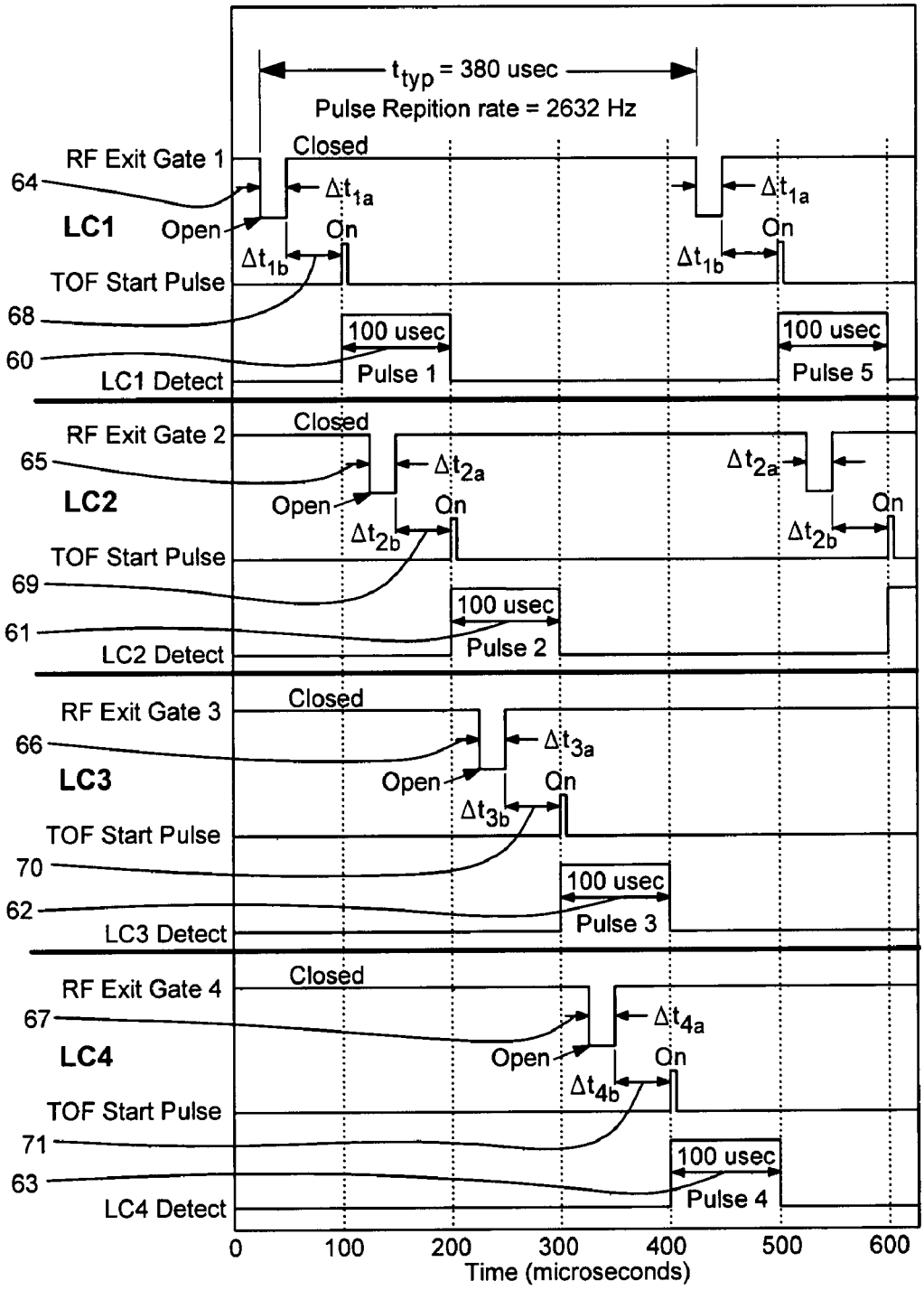
FIG. 3 is a timing diagram of the potentials applied to the individual RF multipole ion guide exit lenses to achieve sequential and non-overlapping injection of their individual ion packets.

A depiction of the overall timing for the injection of four separate chromatograms into a single TOF-MS is shown in FIG. 3. It is assumed in the schematic that all ions will be recorded within a 100 microsecond window 60, 61, 62, 63. This implies that all m/z values are low enough and the flight tube short enough that no ions will need more than 100 microseconds to arrive at the ion detector (FIG. 2, ref. 100). For most biological applications with commercially viable flight tube lengths and potentials, this assumption is reasonable. Access to the TOF flight tube is divided equally between the various chromatograms, although one could preferentially sample certain liquid streams at different frequencies by altering the pulse-out instruction sequence. Each ion trap and its associated ion packet is granted access to the flight tube in 100 microsecond blocks. In theory, any number of sample streams could be accommodated with this method. In practice, for N>>4 experimental conditions would have to be controlled in order to avoid losses due to overfilling. This could be accommodated by injecting fewer charges per unit time, using a larger ion trap volume with greater charge storage capacity, and/or selectively emptying the two dimensional ion trap while filling through the use of a low mass, high mass or bandpass filter.

Immediately preceding the time block $t_{flight}$ 60, 61, 62, 63 for any sample stream 5, 6, 7, 8, the ion trap must be opened for a predetermined period of time $t_{emit}$ 64, 65, 66, 67 (several microseconds or more) in order to allow an ion packet to emit towards the TOF-MS. Emission is immediately followed by a time interval $t_{transit}$ 68, 69, 70, 71 which allows the ion packet suitable time to enter the TOF-MS extraction region 40. In practice this time interval is determined by the ion packet's electrostatic energy and by the physical distance $L_{gap}$ from the trap exit 33, 34, 35, 36 to the centerline of the TOF extraction region 40. For instance, in the case where $E_{ion}$=0 eV and $L_{gap}$=10 cm, $t_{transit}$ 68, 69, 70, 71 will be approximately 40 microseconds for low molecular weight species under 1000 amu. While ions from the first sample stream 5 are being separated in the flight tube 41, the same timing diagram is executed against the second sample stream 6, cueing up and delivering an independent and unrelated ion packet as soon as the 100 microsecond flight window 60 expires. For N=4 and the aforementioned assumptions, each of the four different sample streams 5, 6, 7, 8 may be sampled with zero loss in duty cycle 2,632 times every second, allowing even rapid time-varying processes to be monitored despite the extreme multiplexing.

Figure 4:
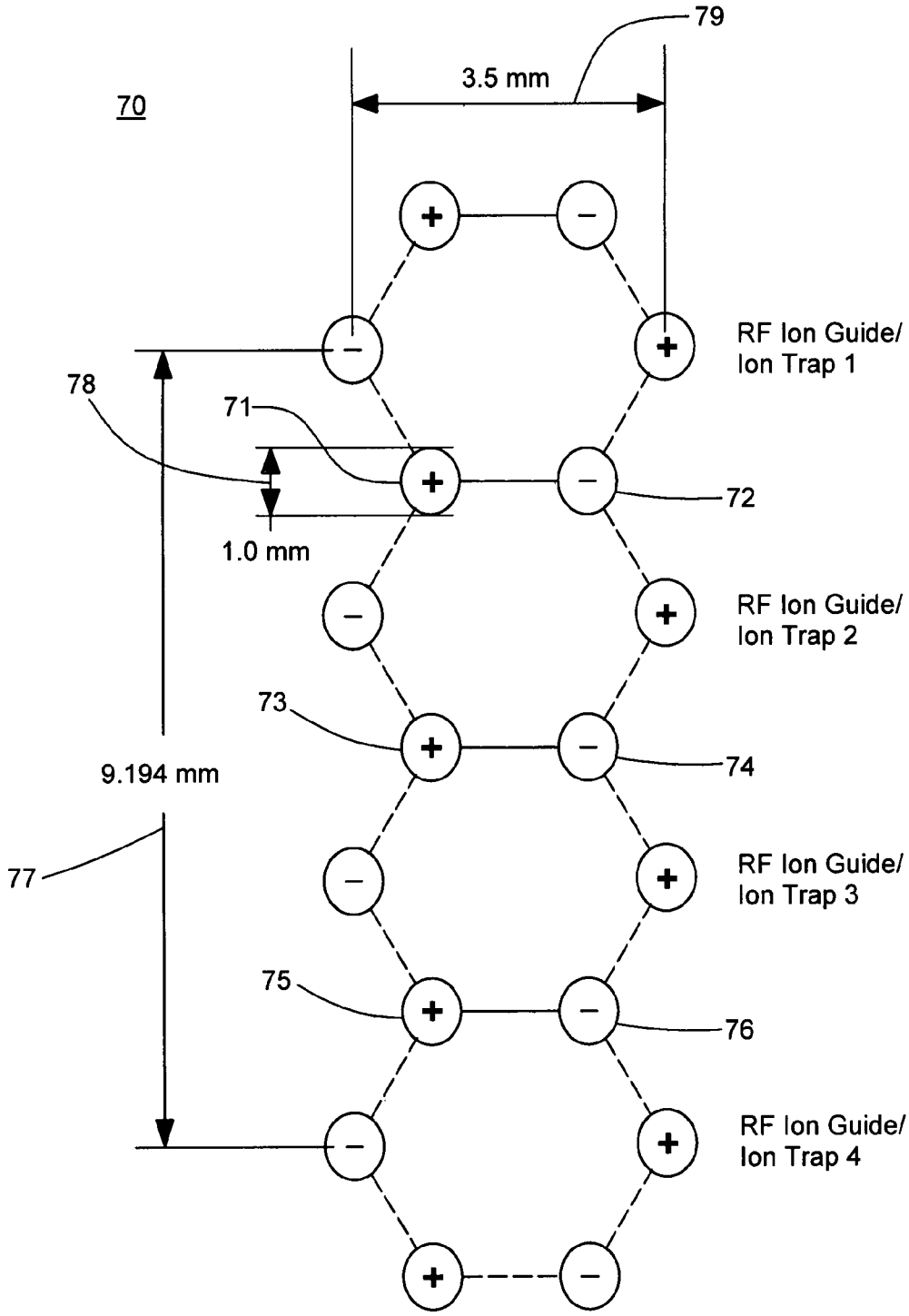
FIG. 4 is a schematic representation of an RF hexapole ion guide array for the purposes of minimizing the aggregate ion beam width admitted into a time-of-flight extraction region.

Performance of the orthogonal extraction TOF-MS is strongly effected by the properties of the incoming ion beam. In order to interface multiple ion beams with multiple points of origination, two conditions must necessarily be met if the flight tube optics and their voltages are to function for all N beams. First the ion packets must be introduced to the extraction region 40 parallel to one another and varying only in position along the y plane. In this manner all ions will develop the same electrostatic energies upon acceleration, neglecting field aberrations and other higher order effects. Secondly, the line length L determined by the distance from the centerline of the two most extreme ion traps 43 & 46 should be kept to a minimum. This permits the extraction region 40 to receive the different ion packets without becoming unduly large or being compromised by fringing fields which form when pulsed potentials are applied. In this manner, the required dimension of the extraction region 40 can be held to a reasonable value for typical laboratory operations, and the different mass spectra resulting from mass separation of each of the ion traps' ions will be more closely related. In order to minimize the required height of the extraction region 40 of the TOF-MS (in the y plane) it is advantageous to store ions in two dimensional ion guides 25, 26, 27, 28 which are closely spaced in the y direction. As shown in FIG. 4, a multipole array 70 may be constructed which takes advantage of shared poles 71, 72, 73, 74, 75, 76 to best compress the required line length L 77. For instance, for four hexapole ion traps with individual poles of 1.0 mm diameter 78 and hexapole diameters 79 of 3.5 mm, one can construct a four ion trap array 70 with a line length L 77 of 9.194 mm. This value compares favorably to constructing four separate hexapoles with 2 mm spacing between each, which would require over 16 mm of line length and which would further challenge construction of a compact and efficient extraction region 40.

Figure 6:
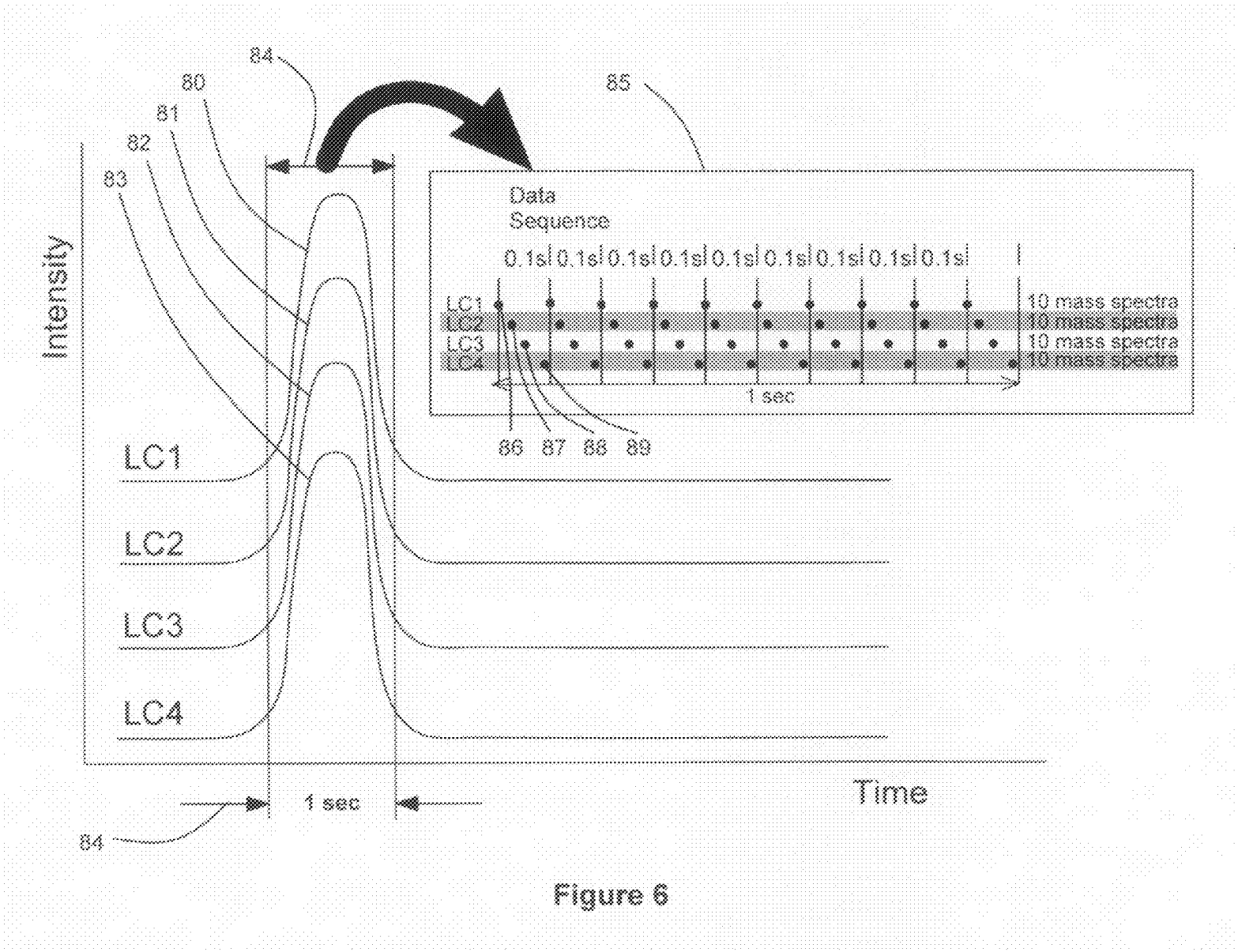
FIG. 6 is a schematic representation of a worst-case mass spectrometric requirement for a parallel ion storage time-of-flight mass spectrometer, depicting four simultaneously arriving effluent peaks of 1 s duration.

To illustrate the utility of the invention, a hypothetical experiment requiring the separation and detection of four separate liquid streams 5, 6, 7, 8 is shown in FIG. 6. As a worst-case scenario, it is envisioned that one chromatography peak 80, 81, 82, 83 from each of four separate sample streams 5, 6, 7, 8 will arrive simultaneously, and that each peak will only be 1 second in duration 84. In order to mass spectrometrically detect these peaks, and to do so in a manner that faithfully reproduces the time-varying nature of the samples on a sub-second basis, it is essential that each of these peaks be repetitively sampled over the course of the 1 second peak elution 84. As a matter of preferred practice it is desirable to oversample such LC peaks 80, 81, 82, 83, acquiring mass spectral data at a rate 5-10 times as fast as the narrowest characteristic peak width. In this example 85, 10 spectra per second are desired for each of the four sample streams 5, 6, 7, 8, requiring the TOF-MS to acquire forty integrated mass spectra. The inset 85 in FIG. 6 illustrates one possible data acquisition timing sequence that accomplished this. The inset 85 shows that mass spectra are acquired every 0.025 seconds, as indicated by the dots, for example 86, 87, 88, 89, sequentially from each of the four sample steams 5, 6, 7, 8, such that a mass spectrum is acquired from any one sample stream 5, 6, 7, 8 every 0.1 seconds, resulting in 10 spectra per second for each sample stream 5, 6, 7, 8.

Figure 7:
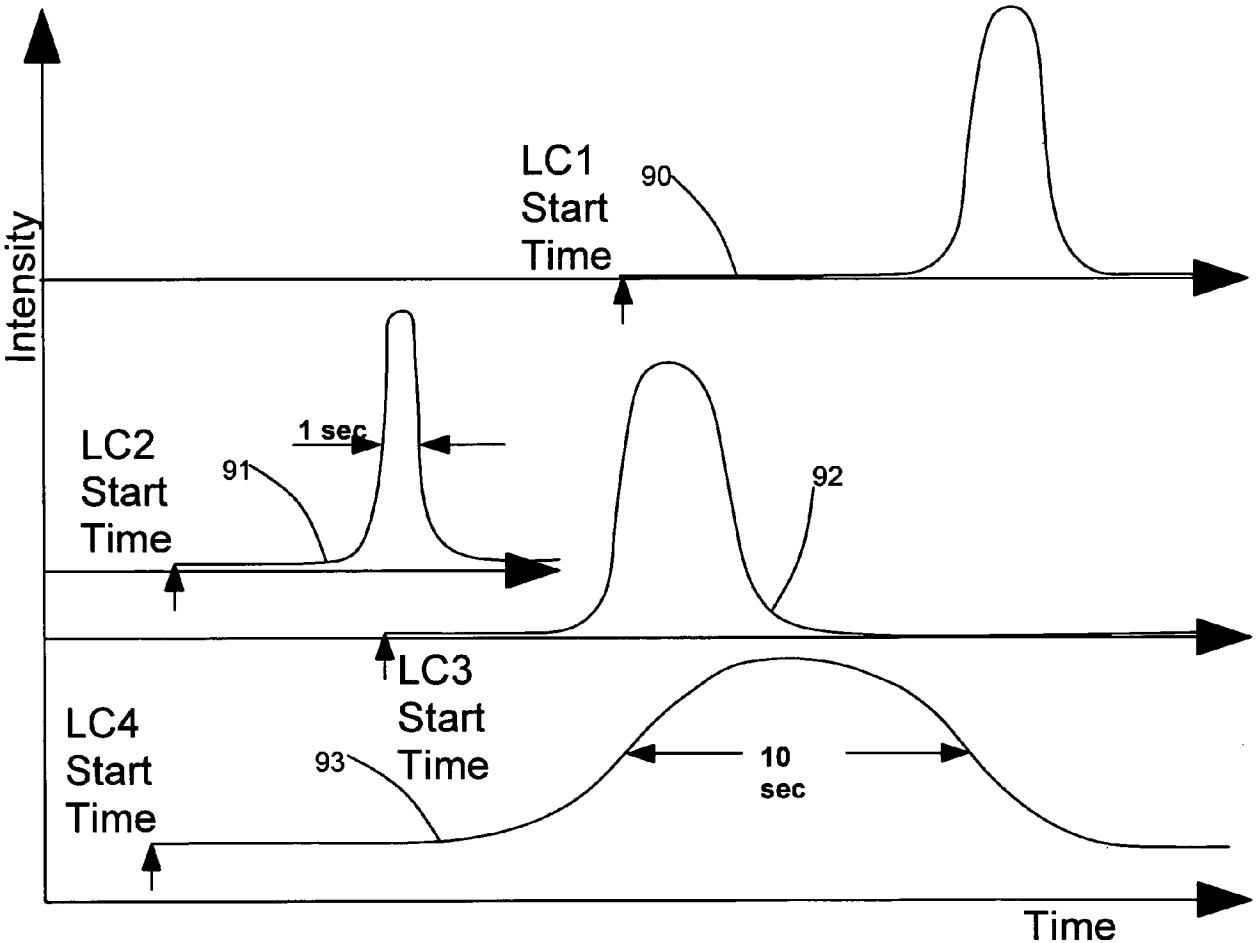
FIG. 7 is an illustration of the simultaneous detection of four chromatograms with varying start times, characteristic peak widths. A total of 10 integrated mass spectra per second are obtained for each chromatogram, for a total of 40 mass spectra per second.

The integration of the mass spectra associated with each of the sample streams may be treated asynchronously with respect to one another, provided each sample stream's raw data are integrated frequently enough to faithfully reproduce its underlying chromatogram. Consider the following example. Four sample streams must be ionized and mass spectrometrically analyzed by the present invention. However, these sample streams are not started at the same time, require different time intervals to complete their respective separations, and have different characteristic peak widths. The properties of these four hypothetical chromatograms 90, 91, 92, 93 are shown in FIG. 7.

This example serves to illustrate that there may be variation between chromatograms in each of the following:

1. Start time
2. Duration
3. Characteristic peak width, and therefore required MS integration rate Given these variations, the present invention may be called upon to render differing numbers of integrated mass spectra every second for each of the sample streams being analyzed. For instance, in FIG. 7, Chromatograph 2 91 represents a fast, high resolution LC separation, requiring 10 MS spectra per second. Chromatogram 4 93, in contrast, is a far longer separation with characteristic peaks that are 10 times as wide. Comparing these two extremes highlights several important facets of the invention. First, each stream, regardless of its characteristic LC time constants, may be sampled at a fixed and high rate which is determined by the ion capacity of the two dimensional ion trap, in this case sampled at 2500 pulses per second, for example. Second, varying number of pulses are added together to comprise an integrated mass spectrum, based entirely upon the characteristic peak widths expected from the LC chromatogram. In the case of Chromatogram 2 91, 250 pulses are added to complete an integrated mass spectrum, yielding the required 10 spectra per second. For Chromatogram 4 93, 2500 pulses are added together to yield the required 1 spectra per second. Both of these integration needs may be serviced simultaneously with the present invention.

In order to satisfy both this integrated mass spectral rate as well as the pulse frequency rate described above and shown in FIG. 3, it is necessary to add the signals from a number of consecutive pulses associated with a given sample stream. For example referring to FIG. 3, sample stream 1 is introduced to the mass spectrometer during Pulse 1, Pulse 5, Pulse 9, and so forth. Every fourth pulse is added together until the time interval representing the mass spectral rate (in this case 0.1 sec, or 10 spectra per second) has elapsed.

Although the invention has been described in terms of the specific preferred embodiments, it will be obvious and understood to one of ordinary skill in the art that various modifications and substitutions are contemplated by the invention disclosed herein and that all such modifications and substitutions are included within the scope of the invention as defined in the appended claims.

The invention claimed is:

1. An apparatus for analyzing chemical species, comprising:

(a) at least two ion sources for producing ions from said chemical species;

(b) at least two two-dimensional ion traps, each said ion trap comprising an entrance end where ions enter said ion trap and an exit end where ions exit said ion trap;

(c) means for transporting said ions from said ion sources to said entrance ends, such that ions from each said source are transported to said entrance end of a separate one of said ion traps, respectively;

(d) at least two ion trap exit lenses, wherein each said exit lens is located proximal to each of said ion trap exit ends, respectively;

(e) a fast voltage switching device for switching voltage levels applied to each said exit lens between a first voltage level whereby ions are prevented from exiting said ion trap, and a second voltage level whereby ions exit said ion trap;

(f) a mass analyzer and detector for mass analyzing said ions exiting said ion traps and producing an output signal responsive to said ions following mass analysis;

(g) a data acquisition system for recording said output signal;

(h) an accurate timing device for controlling the timing and durations of said exit lenses voltage levels.

2. The apparatus of claim 1, wherein said ion sources operate at substantially atmospheric pressure.

3. The apparatus of claim 2, wherein said ion sources include at least one electrospray ion source.

4. The apparatus of claim 3, wherein said electrospray ion source is a micro-electrospray ion source.

5. The apparatus of claim 4, wherein said micro-electrospray ion source operates at liquid flowrate of less than 1 microliter per minute.

6. The apparatus of claim 2, wherein said ion sources include at least one atmospheric pressure chemical ionization source.

7. The apparatus of claim 2, wherein said ion sources include at least one inductively coupled plasma ion source.

8. The apparatus of claim 1, wherein said ion sources operate at sub-atmospheric pressure.

9. The apparatus of claim 8, wherein said ion sources include at least one electron impact ion source.

10. The apparatus of claim 8, wherein said ion sources include at least one glow discharge ion source.

11. The apparatus of claim 8, wherein said ion sources include at least one matrix assisted laser desorption ion source.

12. The apparatus of claim 1, wherein said mass analyzer is a time-of-flight mass spectrometer.

13. The apparatus of claim 12, wherein said time-of-flight mass spectrometer is an orthogonal time-of-flight mass spectrometer with a flight tube oriented perpendicular to the axis of said ion traps.

14. The apparatus of claim 12, wherein said time-of-flight mass spectrometer is an in-line time-of-flight mass spectrometer with a flight tube oriented parallel to the axis of said ion traps.

15. The apparatus of claim 12, wherein said time-of-flight mass spectrometer contains a reflectron to compensate for energy distribution of said ions.

16. The apparatus of claim 1, wherein said mass analyzer is an ion trap mass spectrometer.

17. The apparatus of claim 16, wherein said ion trap mass spectrometer is a three dimensional ion trap mass spectrometer.

18. The apparatus of claim 1, wherein said mass analyzer is a Fourier Transform mass spectrometer.

19. The apparatus of claim 1, wherein said mass analyzer is a tandem mass spectrometer.

20. The apparatus of claim 19, wherein said tandem mass spectrometer includes at least one time-of-flight mass spectrometer.

21. The apparatus of claim 19, wherein said tandem mass spectrometer includes at least one ion trap mass spectrometer.

22. The apparatus of claim 19, wherein said tandem mass spectrometer includes at least one Fourier Transform mass spectrometer.

23. The apparatus of claim 1, wherein said data acquisition system associates the signal arising from a particular ion packet with a specific ion source using temporal encoding.

24. The apparatus of claim 23, wherein said temporal encoding consists of a means of synchronizing ion pulses from each of said ion traps with specific data acquisition channels which partition the data stream according to its ion source.

25. The apparatus of claim 24, wherein said temporal encoding consists of a particular mass-to-charge species being present or absent in said signal.

26. The apparatus of claim 1, wherein said data acquisition system associates individual signals with specific ion sources using chemical encoding.

27. The apparatus of claim 1, wherein said ion traps are operated in such a manner that for the interval of time during which said ion trap is forbidden to transmit ion packets to the mass analyzer, said ions entering said ion trap are substantially accumulated to preserve analytical sensitivity.

28. The apparatus of claim 1, wherein one or more of said multipole ion traps is a quadrupole.

29. The apparatus of claim 1, wherein one or more of said ion traps is a hexapole.

30. The apparatus of claim 1, wherein one or more of said ion traps has more than six poles.

31. The apparatus of claim 1, wherein said ion traps are operated in such a manner that a packet of said ions from no more than one said ion trap be permitted in said mass analyzer at any given time.

32. The apparatus of claim 1, wherein said ion traps are operated in such a manner that packets of said ions from two or more said ion traps be permitted in the said mass analyzer at any given time provided the individual mass-to-charge peaks within the composite signal can be clearly associated with its respective ion source unequivocally.

33. The apparatus of claim 1, wherein said mass analyzer comprises a time-of-flight mass analyzer having an extraction region and a flight tube axis, and wherein ion packets intersect said extraction region in a plane which is parallel to said ion traps axis and perpendicular to said flight tube axis.

34. A method for analyzing chemical species, comprising the steps of:

(a) directing a first sample solution to a first ion source, a second sample solution to a second ion source, and any third, fourth, and additional sample solutions to a third, fourth, and additional ion sources, respectively;

(b) ionizing said sample solutions with said ion sources;

(c) directing ions from said first ion source to an entrance end of a first linear ion trap, ions from said second ion source to an entrance end of a second linear ion trap and ions from said any third, fourth, and additional ion sources to entrance ends of third, fourth, and additional linear ion traps, respectively;

(d) trapping said ions in said ion traps;

(e) releasing at least a portion of said trapped ions from at least two of said ion traps sequentially; and, (f) directing each of said portions sequentially into a mass analyzer for mass to charge analysis of said ions such that each of said portions is mass to charge analyzed separately.

* * * * *